US008776283B2

(12) United States Patent
Garrels et al.

(10) Patent No.: US 8,776,283 B2
(45) Date of Patent: Jul. 15, 2014

(54) MOVABLE SEAT FOR SHOWER STALL

(75) Inventors: Clayton C. Garrels, Sheboygan, WI (US); Thomas M. Spankowski, Port Washington, WI (US); Jason R. Miller, Sheboygan Falls, WI (US)

(73) Assignee: Kohler Co., Kohler, WI (US)

( * ) Notice: Subject to any disclaimer, the term of this patent is extended or adjusted under 35 U.S.C. 154(b) by 420 days.

(21) Appl. No.: 13/082,228

(22) Filed: Apr. 7, 2011

(65) Prior Publication Data

US 2011/0252561 A1 Oct. 20, 2011

Related U.S. Application Data

(60) Provisional application No. 61/324,099, filed on Apr. 14, 2010.

(51) Int. Cl.
*A47K 3/00* (2006.01)

(52) U.S. Cl.
USPC ..... 4/611

(58) Field of Classification Search
USPC ..... 297/187, 195.11, 451.4, 451.7, 451.12; 4/571.1, 573.1, 578.1, 579, 611; D23/283, 304
See application file for complete search history.

(56) References Cited

U.S. PATENT DOCUMENTS

| | | | | |
|---|---|---|---|---|
| 3,193,848 A | | 7/1965 | Levy | |
| 4,087,127 A | | 5/1978 | Lotta | |
| 4,987,619 A | | 1/1991 | Smith | |
| 5,090,068 A | | 2/1992 | Zellner | |
| 5,720,522 A | * | 2/1998 | Habeck | 297/337 |
| 5,732,421 A | | 3/1998 | Scherberger | |
| 6,065,251 A | | 5/2000 | Kindrick | |
| 6,640,354 B2 | | 11/2003 | Bonack et al. | |
| 6,804,842 B1 | * | 10/2004 | Johnson | 4/578.1 |
| 2010/0251476 A1 | | 10/2010 | Bates | |

FOREIGN PATENT DOCUMENTS

| | | |
|---|---|---|
| DE | 33 32 683 A1 | 3/1985 |
| DE | 44 01 258 A1 | 7/1995 |
| DE | 203 05 904 U1 | 9/2003 |
| DE | 20 2007 008505 U1 | 8/2007 |
| EP | 0 492 147 A2 | 7/1992 |
| WO | WO 2011/130357 A1 | 10/2011 |

OTHER PUBLICATIONS

International Search Report of International Publication No. WO 2011/130357 A1; published Oct. 20, 2011; 4 pages.
2008 web site excerpt by 1-800-wheelchair.com, entitled Portable Shower Bench.

* cited by examiner

*Primary Examiner* — Gregory Huson
*Assistant Examiner* — Janie Christiansen
(74) *Attorney, Agent, or Firm* — Foley & Lardner LLP

(57) ABSTRACT

A movable seat is disclosed which is positionable within a shower stall of a type having at least one rear support element, such as a rear ledge, and at least one frontal support element, such as a lower frontal threshold. The movable seat includes an essentially horizontal support that has a rearward portion that is suitable to be supported on the ledge and a leg that extends downwardly from a forward portion of the support to a foot. The seat is sufficiently flexible such that if a weight load of a human or thereabout is placed on the support, then the foot will flex forwardly in response thereto, thereby jamming the seat in place relative to the shower stall.

18 Claims, 8 Drawing Sheets

MOVABLE SEAT FOR SHOWER STALL

CROSS-REFERENCE TO RELATED APPLICATION

This patent application claims priority to U.S. provisional application Ser. No. 61/324,099 filed Apr. 14, 2010, the contents of which is incorporated by reference as if set forth in its entirety herein.

STATEMENT OF FEDERALLY SPONSORED RESEARCH OR DEVELOPMENT

Not applicable.

BACKGROUND

This disclosure relates to showering or bathing enclosures, such as shower stalls, and in particular to movable seats for use therewith.

SUMMARY

According to an exemplary embodiment, a movable seat positionable within a shower stall is provided. The shower stall is of a type having a rear ledge and a lower frontal threshold. The movable seat comprises an essentially horizontal support having a rearward end portion that is suitable to be supported on the rear ledge; and a leg extending downwardly from a forward portion of the support to a foot. The seat is sufficiently flexible so that, if a weight load of one hundred pounds or more is placed on the essentially horizontal support, the foot will flex forwardly in response thereto. In some exemplary embodiments, the leg slopes downwardly and forwardly. In some exemplary embodiments, the essentially horizontal support is joined to the leg by a flexible elbow. In some exemplary embodiments, the essentially horizontal support, the leg, the foot and the elbow are integrally formed with one another. In some exemplary embodiments, the movable seat comprises at least one of polypropylene, metals, thermoplastic polymers, thermoset polymers, composites, and cellulose materials. In some exemplary embodiments, the rearward end portion of the essentially horizontal support comprises a rearwardly extending projection. In some exemplary embodiments, the rearwardly extending projection has a pair of stops on opposing sides of the rearwardly extending projection. In some exemplary embodiments, the movable seat weighs no more than 10 pounds.

According to another exemplary embodiment, a shower stall comprises an upper rear ledge on a rear wall, a lower frontal threshold, and a seat. The seat comprises an essentially horizontal support having a rearward end portion that is supported on the upper rear ledge; and a leg extending downwardly and forwardly from a forward portion of the essentially horizontal support to a foot, the foot being positioned at least in part behind the lower frontal threshold. The seat is sufficiently flexible that if a weight load of one hundred pounds or more is placed on the essentially horizontal support the foot will flex forwardly in response thereto so as to secure the seat between the lower frontal threshold and a rear wall of the shower stall. In some exemplary embodiments, the essentially horizontal support is joined to the leg by a flexible elbow. In some exemplary embodiments, the rear wall has at least two such discrete, spaced apart, upper rear ledges, such that the seat can be alternatively positioned. In some exemplary embodiments, the upper rear ledge runs along the rear wall for at least a majority of its length and the seat is slideably positionable on the upper rear ledge.

According to another exemplary embodiment, a movable seat comprises an essentially horizontal support; a leg extending generally downward and outward from a forward portion of the essentially horizontal support; a rearward end portion configured to be supported by a shower stall at a first height; and a forward end portion configured to be supported by the shower stall at a second height, the first height being greater than the second height. In some exemplary embodiments, the first height substantially corresponds to a distance between the essentially horizontal support and a floor of the shower stall. In some exemplary embodiments, the rearward end portion comprises a projection. In some exemplary embodiments, the forward end portion comprises two or more toe portions. In some exemplary embodiments, at least a portion of a sitting surface of the essentially horizontal support is substantially convex. In some exemplary embodiments, a foot at the forward end of the leg includes an upwardly recessed surface between two or more toe portions. In some exemplary embodiments, the movable seat further comprises a recessed portion proximate to the forward end portion. In some exemplary embodiments, the movable seat is an injection molded polypropylene movable seat.

According to still another exemplary embodiment, a method of installing a movable seat in a shower stall is provided. The stall is of a type having an upper rear ledge and a lower frontal threshold. The method includes obtaining a movable seat. The movable seat includes an essentially horizontal support having a rearward portion that is suitable to be mounted on the ledge. Further, the movable seat includes a leg extending downwardly from a forward portion of the support to a foot, the foot being suitable to be restrained against forward movement by the threshold. This seat is sufficiently flexible such that, if a weight load of one hundred pounds or more is placed on the support, the foot will flex forwardly in response thereto. The method includes placing the rearward portion on the ledge and the foot at least in part behind the threshold, and thereafter having a human sit on the support and jamming the seat between the threshold and a rear portion of the stall.

Hence, it will be appreciated that the present disclosure provides an improved movable seat. When a person does not need the seat to take a shower, the seat is lightweight and can be readily removed from a shower stall. Then, when the seat is desired at a later time for a seated shower, the seat can be readily reinserted in the shower stall.

As the seat may be secured in place by the weight of the user, the seat itself does not require any mounting hardware to be mounted to the interior of the shower stall. The weight of a user will cause the front of the seat to press against (e.g., be restrained against) the front threshold and the rear shower wall. This essentially creates a jam fit that holds the seat in place during use and avoids unwanted tipping. When the seated individual stands up, the seat is automatically able to be moved in the stall or removed from the stall altogether.

Further, whereas the designs of more permanent seats must take into account the space left for an unseated shower user, the movable seat of this disclosure is not so restricted and can be made wider or otherwise sized to be more comfortable.

These advantages are achieved without needing to make any holes through the enclosure walls, and without needing to use complex attachments such as hinges to achieve the required flexibility in positioning. Further, such seats are inexpensive to produce.

These and still other advantages will be apparent from the detailed description and drawings. What follows is merely a description of preferred embodiments. To assess the full scope of the invention the claims should be looked to as these preferred embodiments are not intended to be the only embodiments within the scope of the claims.

DETAILED DESCRIPTION

Most able-bodied individuals stand while showering. In the case of standing use of a shower, an overhead shower head typically supplies the water for washing the user. Typically, a lower portion of the shower stall (often referred to as a "receptor", as it links with the side walls of the shower enclosure) collects and drains the water.

While standing use of such showers is the most common, some people, such as the disabled or elderly, may have difficulty standing for the prolonged periods of time needed to complete a shower (e.g., when hair shampooing and rinsing is also involved). Thus, some shower enclosures have been designed with a seat integrally molded into the receptor. An integral seat of this kind permanently occupies significant space of the shower stall. Particularly in connection with compact shower stalls (e.g., those found in some small apartments), the inclusion of such a seat significantly reduces the standing space available in the shower stall for other users.

Removable or hinged seats have been proposed for use with conventional shower stalls. Such seats allow a typical user to shower with the full area of the shower stall, yet allow those who need or want to sit during showering to have that option. However, seats that are hinged or otherwise more permanently attached to a shower wall require modifications to be made to the shower walls. These changes may permanently deface the shower receptor and/or walls during installation and can restrict the location of the seat within the shower stall. Further, these seats may have constructions which make operation and/or the insertion and removal of the seat challenging for a person that needs to use the seat.

When a self-standing seat is placed in the stall for this purpose there is a tendency for the seat to move and/or tip, which is not desirable.

Figure 1:
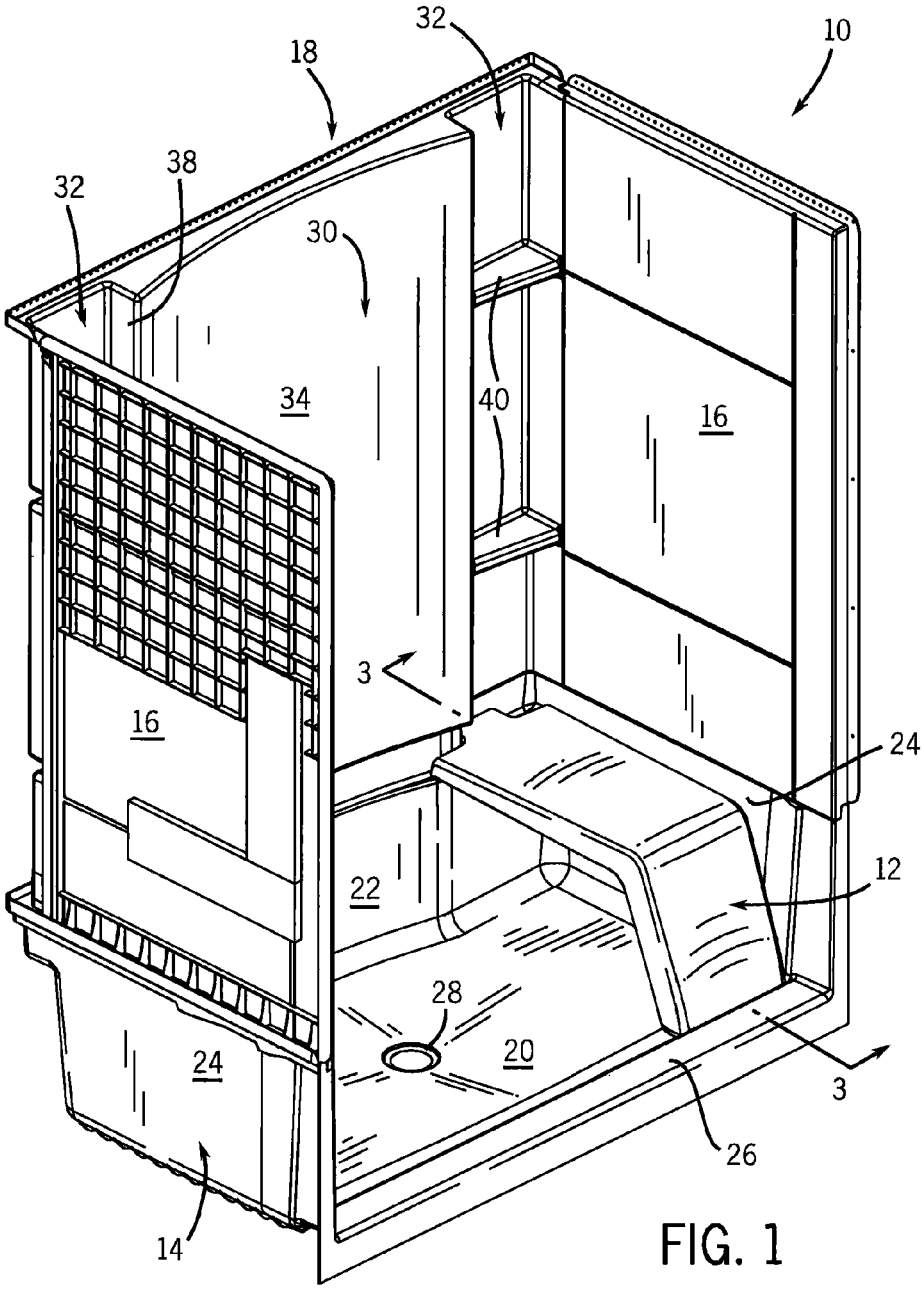
FIG. 1 is a left, frontal, upper perspective view of a shower stall with a seat positioned therein.
Figure 2:
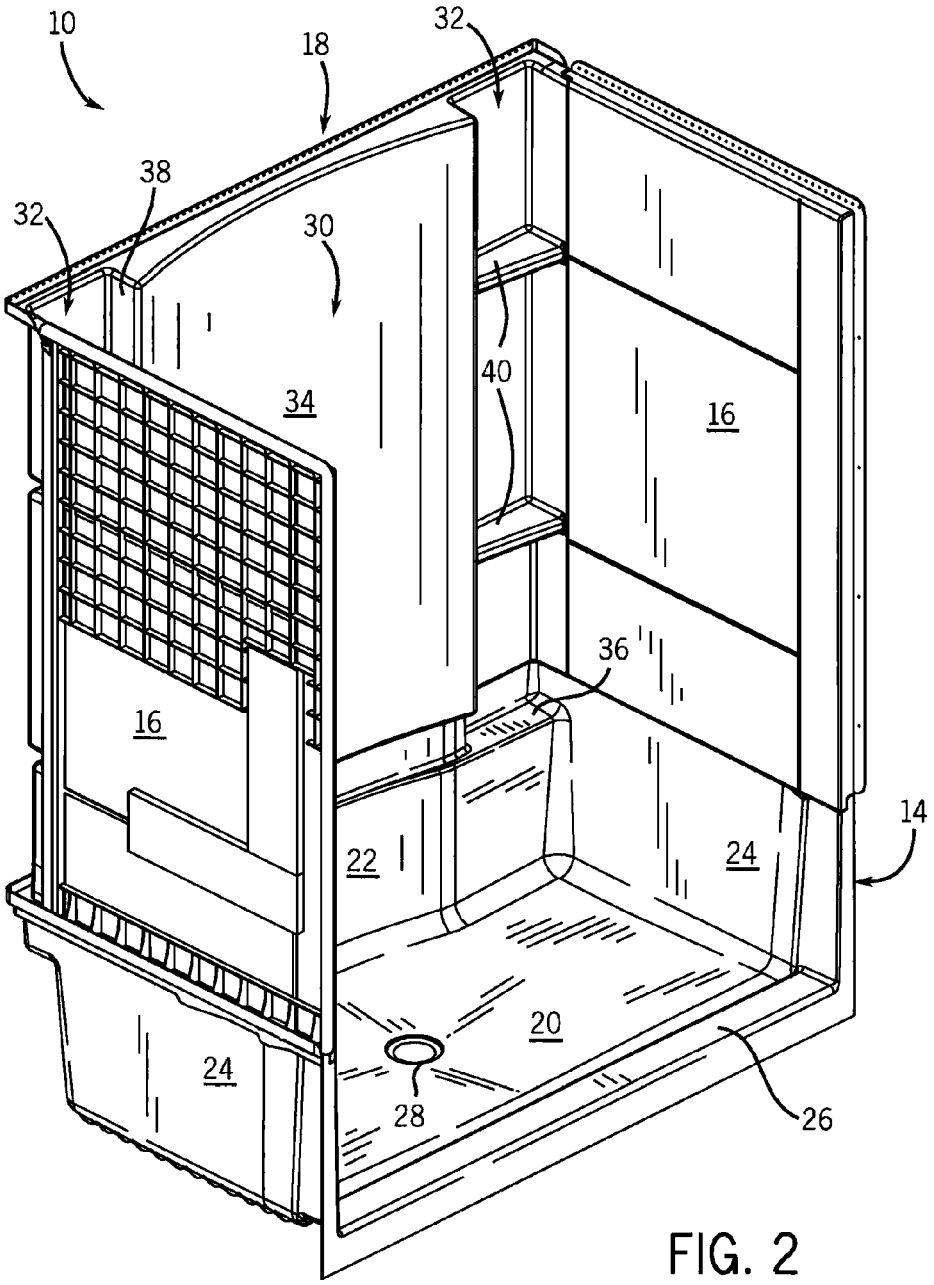
FIG. 2 is a view similar to FIG. 1, but in which the seat has been removed from the shower stall.

Referring first to FIGS. 1 and 2, a shower stall 10 is shown with and without a movable seat 12 positioned therein, respectively. The movable seat 12 may be inserted or removed from the shower stall 10 by a user and, when inserted in the shower stall 10, provides a place for a user to sit while taking a shower. The movable seat 12 does not significantly alter the aesthetic of the shower stall 10 or present complex installation, removal, and/or operation.

According to the exemplary illustration, the shower stall 10 includes a shower stall base portion with connected upper walls. In the particular shower stall shown, the base portion includes a shower receptor 14 and the upper walls include two lateral vertical side walls 16 and a central vertical rear wall 18 that are connected to and extend upwardly from the shower receptor 14. While not shown, a shower curtain or closure door can be attached along the front of the shower stall 10 to create a complete enclosure, with or without the movable seat 12 installed.

While the illustrated shower stall 10 includes multiple connected parts, in other forms, the parts of the shower stall 10 may be differently connected or may be integrally formed with one another. For example, the base portion (e.g., the receptor 14) and the upper walls (e.g., the two lateral vertical side walls 16 and the central vertical rear wall 18) may be integrally formed with one another.

The shower receptor 14 of FIG. 1 includes a floor 20 with a rear wall 22, two side walls 24, and a lower frontal threshold 26 extending upwardly from the floor 20. The lower frontal threshold 26 is typically only an inch or so high to ensure that water falling on the floor 20 will be directed toward a drain 28 rather than out of the shower stall 10. The upper surface of the lower frontal threshold 26 typically is slightly below a lower end of any front door used with the shower stall 10.

According to the exemplary embodiment shown, the angle or grade of a central portion of the floor 20 of the shower receptor 14 is greater than the outer, side portions of the floor 20. This configuration helps facilitate drainage, particularly in the presence of movable seat 12 while maintaining a flat mounting surface for the moveable seat 12.

In the particular shower stall 10 illustrated, the vertical rear wall 18 has a central section 30 and two recessed portions, shown as columns 32, on the lateral sides thereof. The central section 30 has a concavely curved surface 34 to which a grab bar (not shown) and/or other accessories may be mounted. This central section 30, generally speaking, is vertically aligned with the rear wall 22 of the shower receptor 14.

The two recessed columns 32 are rearwardly offset relative to the central section 30 of the rear wall 18 and relative to a forward portion of the rear wall 22 of the shower receptor 14, thereby defining (e.g., creating, establishing, etc.) a pair of upper rear ledges 36 (shown essentially horizontal) and a pair of laterally-facing vertical walls 38. At various points along the two recessed columns 32, there are positioned horizontal shelves 40 which may be used to store personal care products (e.g., shampoo) or the like.

Figure 8:
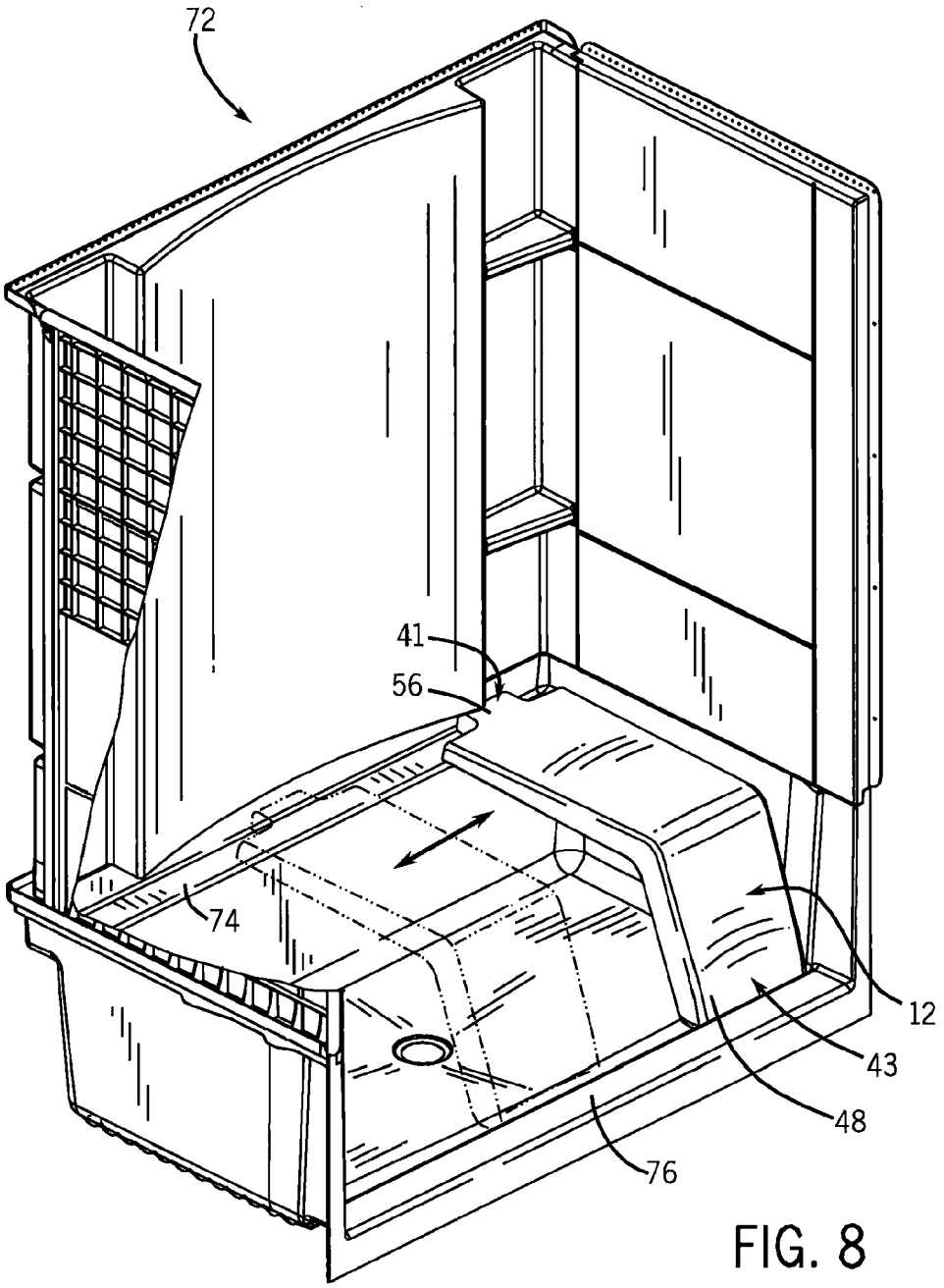
FIG. 8 is a perspective view of another shower stall in which the movable seat is slideable across the length of the stall.

While the shower receptor 14 as shown includes a pair of upper rear ledges 36 separated by a central section 30, the shower receptor 14 may have a single upper rear ledge (as is illustrated in FIG. 8) or more than two upper rear ledges (e.g., recessed and/or outwardly extending). According to some alternative exemplary embodiments, a single continuous upper rear ledge may be provided that runs (e.g., extends, continues, reaches, etc.) the entire length or substantially the entire length of the rear wall of the shower receptor 14.

According to other exemplary embodiments, any support element or feature suitable for providing support for a rearward end portion of the movable seat may be provided. According to still other exemplary embodiments, the ledge or other support element may be defined in/by the walls of the shower stall and/or the shower stall need not include recessed columns to define/include a suitable ledge or other support feature.

Figure 6:
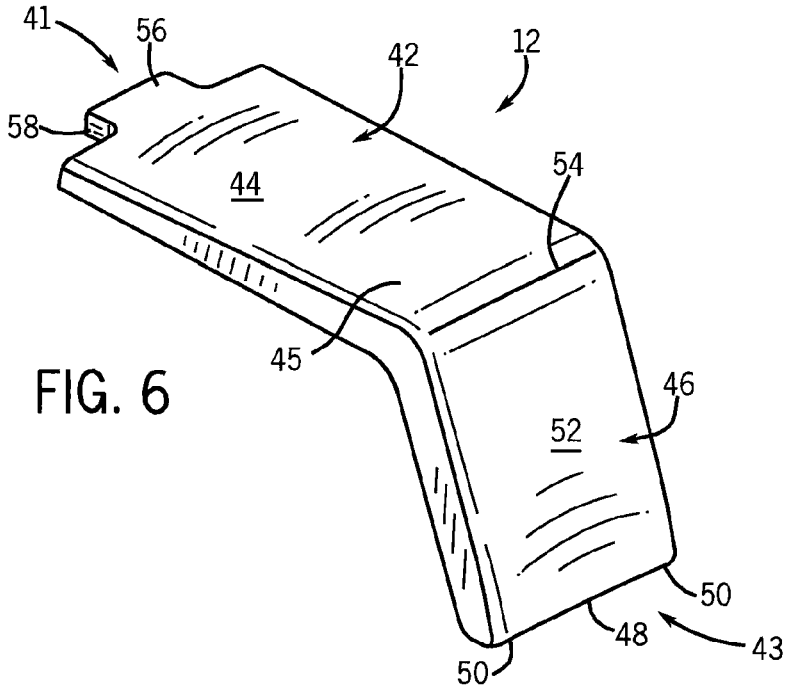
FIG. 6 is a left, frontal, upper perspective view of one embodiment of the seat.
Figure 7A:
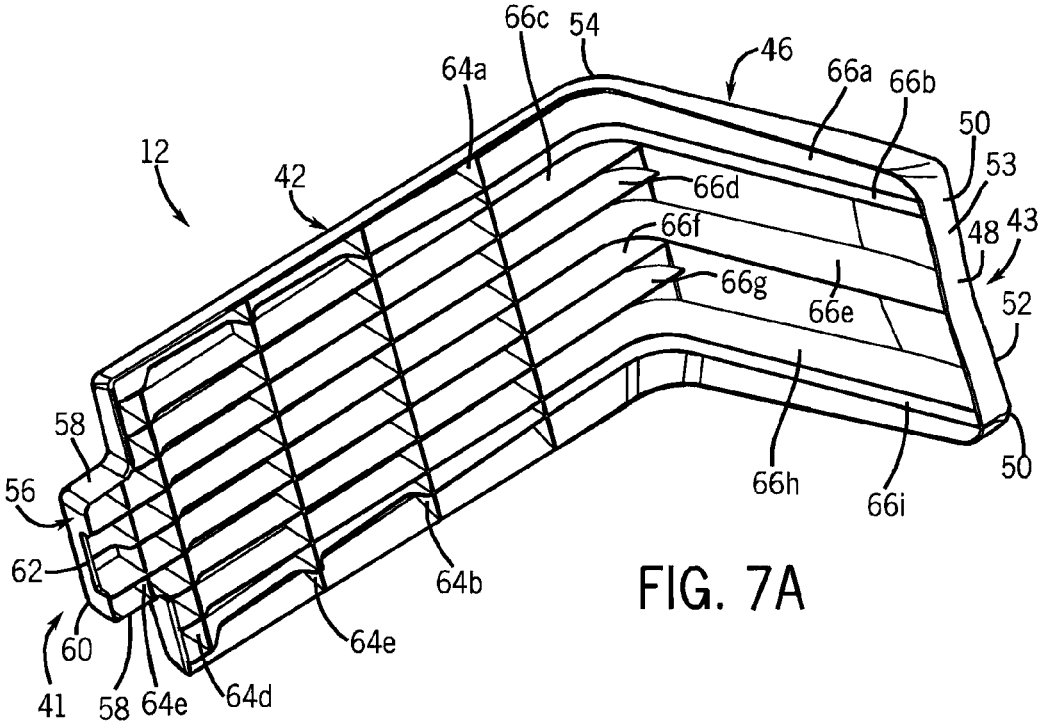
FIG. 7A is a bottom side perspective view of the seat showing one underside rib configuration.

Now with reference to FIGS. 6 and 7A, the movable seat 12 is shown apart from the shower stall 10. The movable seat 12 generally extends from a rearward end portion 41 that is configured to be supported by the shower stall at a first height to a forward end portion 43 configured to be supported by the shower stall at a second height, as will be described in further detail below.

The movable seat 12 includes an essentially horizontal support 42 having an upper sitting surface 44 on which a person may comfortably sit. In some forms, this upper sitting surface 44 or a portion thereof may be slightly crowned (e.g., convex) such that water does not pool on the top of the essentially horizontal support 42.

At a forward end 45 of the essentially horizontal support 42, a leg 46 extends downwardly to a foot 48 at the forward end portion 43. As the leg 46 extends downwardly, it also extends forwardly (relative the placement in the shower receptor 14) such that the plane of the leg 46 and the plane of the essentially horizontal support 42 preferably define an obtuse angle with one another.

The leg 46 has a slight concave curvature near the foot 48 such that the foot 48 has two forwardly extending portions, shown as toes or toe portions 50, on the lateral sides of a recessed central portion 52 according to an exemplary embodiment. As shown, the recessed central portion 52 is slightly rearwardly and upwardly recessed at the foot 48 thereby also defining an upwardly recessed surface 53 between the two or more toe portions 50. This upwardly recessed surface 53 may provide a way (e.g., passage, opening) for water flowing off of the leg 46 to flow into the drain 28 (e.g., rather than out of the shower stall 10 over the threshold 26). For example, the water may flow down the leg 46 generally along the recessed central portion 52, generally rearward between the two toe portions 50 through the upwardly recessed surface 53, beneath the movable seat 12, and then be directed generally toward the drain 28. It should be noted that the foot 48 may be considered to be part of the leg 46 or independent thereof. According to other exemplary embodiments, other combinations of toe and/or recessed portions may be utilized to facilitate efficient draining and/or direct water flow.

The essentially horizontal support 42 and the leg 46 are shown joined at a bend/elbow 54 which is flexible and substantially elastically deformable under the weight of an individual (i.e., approximately 100 pounds or more). In the form shown, the elbow 54 is an integrally molded feature of the movable seat 12 which joins or defines the transition between the essentially horizontal support 42 and the leg 46.

The movable seat 12 is made of an injection molded polypropylene material according to an exemplary embodiment. Injection molded polypropylene has the desired structural properties for forming the seat and for permitting an amount of substantially elastic deformation during use. In other exemplary embodiments, the seat 12 may be comprise one or more of polypropylene, metals, thermoplastic polymers, thermoset polymers, composites, cellulose containing materials (e.g., wood).

Preferably, the movable seat is easily lifted even by a relatively weak or infirm user that may need to use a seat of this kind to shower. While it may weigh more, it is generally desirable that the movable seat 12 weigh no more than 10 pounds; in some particularly desirable embodiments, the movable seat 12 may weigh less than 5.5 pounds.

According to alternative exemplary embodiments of the movable seat 12, a hinged joint or the like may be used to connect the essentially horizontal support 42 to the leg 46. Although not illustrated in the figures, the movable seat 12 could be of a foldable type at the elbow 54, hinge, or joint for easy storage. However, any form of connection between the essentially horizontal support 42 and the leg 46 should allow for some amount of deflection under an applied load of a person, so that the angle between the essentially horizontal support 42 and the leg 46 can be adjusted. As will be described in further detail below with respect to the operation of the movable seat 12, the adjustment of the angle between the essentially horizontal support 42 and the leg 46 permits the displacement of the rearward end portion 41 relative to the forward end portion 43 to secure the movable seat 12 in the shower stall 10 and/or to permit its removal from the shower stall 10.

As is evident from FIGS. 6 and 7A, at the rearward end portion 41 of the essentially horizontal support 42, a rearwardly extending projection 56 extends substantially horizontally from the essentially horizontal support 42. The rearwardly extending projection 56 has a side-to-side length that is less than the side-to-side length of the essentially horizontal support 42 in the exemplary embodiment shown. A pair of stops 58 are on the lateral sides of the projection 56 and may be used to locate the projection 56 relative to a wall, such as against a laterally-facing vertical wall 38 of the shower stall 10. A rearwardly facing wall 60 of the projection 56 is shown including an upside down U-shaped cutout 62 which might be used as a handle to grab that end.

The rearwardly extending projection 56 may take other alternative forms. For example in some forms, the rearwardly extending projection may be in the form of one or more pegs or pins. In still other exemplary forms, the rearwardly extending projection may have a width substantially equal to the essentially horizontal support 42 and may not be stepped.

With specific reference to FIG. 7A, the underside of the movable seat 12 has a number of ribs formed thereon in a pattern that provides selective structural reinforcement for the shell that defines the major surfaces of the essentially horizontal support 42, the leg 46, and the elbow 54. In the particular form illustrated, five laterally-extending ribs 64*a* through 64*e* extend from one lateral side to the other lateral side of the movable seat 12. All five of these laterally extending ribs 64*a* through 64*e* are located in the essentially horizontal support 42. It should be appreciated that while ribs are shown in the illustrated embodiment, that other reinforcement structures may also be used to impart sufficient strength to the seat while still affording the seat ample flexure in the appropriate locations. For example, a different material, potentially non-plastic, could be overmolded with plastic or adhered to the plastic to achieve similar strength, flexibility, and cost benefits.

Figure 3A:
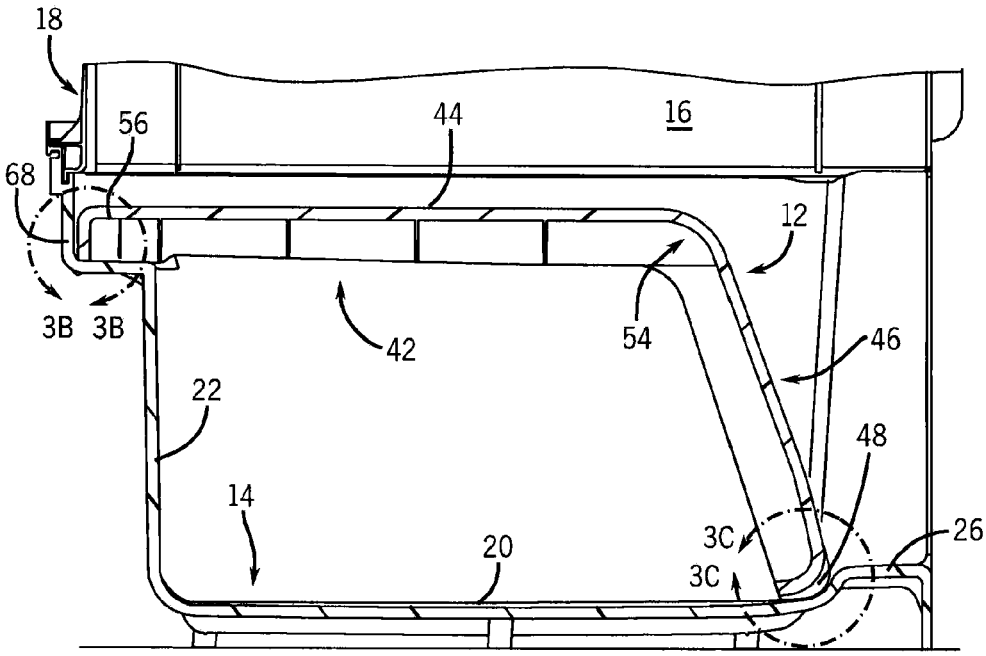
FIG. 3A is a view taken along line 3-3 of FIG. 1.
Figure 4A:
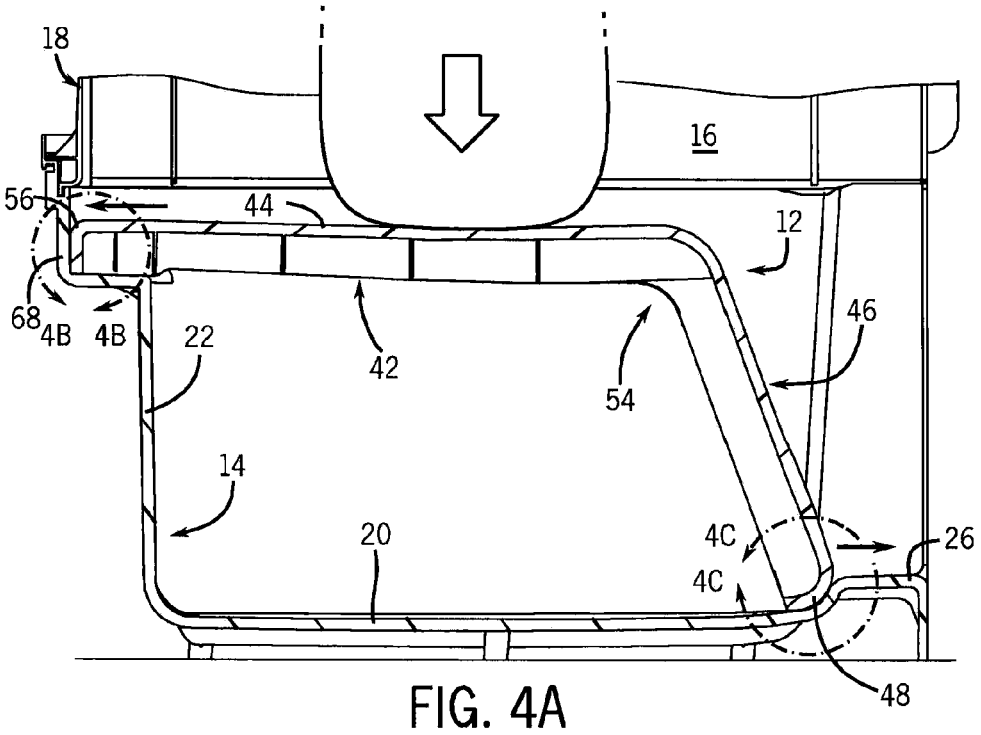
FIG. 4A is a view similar to FIG. 3A, but in which a weight (e.g., a human) is placed on the seat.

The three of these laterally-extending ribs 64*a* though 64*c* closest to the elbow 54 run the entire length of the essentially horizontal support 42. One of the laterally-extending ribs 64*e* is found in the projection 56 and runs between the pair of stops 58. Yet another laterally extending rib 64*d* is positioned between the rib 64*e* of the projection 56 and the three other ribs 64*a* through 64*c*. The rib 64*d* does not extend the full width of the essentially horizontal support 42, but does have a greater height relative to the walls forming the shell as best illustrated in FIGS. 3A and 4A.

Nine front-to-back ribs 66*a* through 66*i* extend from the rear or back of the movable seat 12 proximate the projection 56 forward to the elbow 54 and, in some cases, through the leg 46. Five of the front-to-back ribs 66*a*, 66*b*, 66*e*, 66*h*, and 66*i* run through the movable seat 12 from the essentially horizontal support 42, across the elbow 54, and through the leg 46 to the foot 48. The five ribs that run substantially the entire length of the movable seat 12 include a center rib 66*e* and the two ribs (pairs 66*a*, 66*b* and 66*h*, 66*i*) on each lateral side of the movable seat 12. The most laterally outward ribs 66*a* and 66*i* on each side taper slightly inward as they run from the back from rib 64*d* to the front of the essentially horizontal support 42, but then run parallel to the other ribs down the leg 46.

The four other ribs 66*c*, 66*d*, 66*f*, and 66*g* only run from the back side of the essentially horizontal support 42 to the elbow 54. These shorter ribs run in pairs between the central rib 66*e* and the pairs of the most laterally outward ribs 66*a*, 66*b* and 66*h*, 66*i*. Notably, the ribs 66*a*-66*i* are of a greater height proximate the laterally extending rib 64*d* and then taper as they extend away from the rib 64*d* towards the projection 56. The ribs are sized such that these ribs, and not the walls forming the shell of the movable seat 12, will engage the shower receptor 14 when the movable seat 12 is placed in contact with the upper rear ledge 36 the shower stall 10.

Figure 7B:
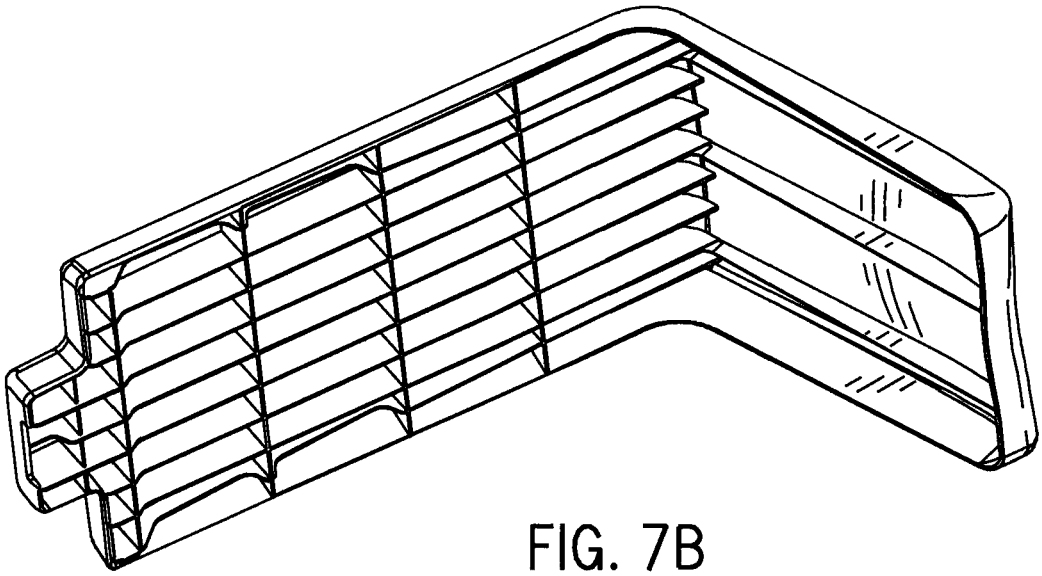
FIG. 7B is a bottom side perspective view of the seat with a different underside rib configuration.

With reference to FIG. 7B, a generally preferred and alternative underside rib structure is illustrated that differs in two ways from the rib structure shown in FIG. 7A. The first difference is that two of the front-to-back ribs (corresponding to ribs 66*a* and 66*i* in FIG. 7A) do not extend the full length of the seat in FIG. 7B, but rather extend only from the rearward end portion to the elbow. The second difference is that the three remaining front-to-back ribs that do run the entire distance of the seat (i.e., the ribs in FIG. 7B that correspond to the ribs 66*b*, 66*e*, and 66*h* in FIG. 7A) are only approximately one half height from the elbow to the forward end portion. Among the benefits of the rib structure of FIG. 7B is that a rib structure of this type is more easily fabricated and removed from the mold and, furthermore, uses less material.

Figure 3B:
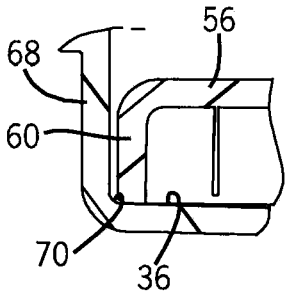
FIG. 3B is a detailed view as defined by line 3B-3B of FIG. 3A.
Figure 3C:
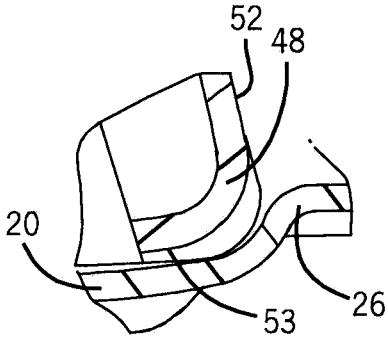
FIG. 3C is a detailed view as defined by line 3C-3C of FIG. 3A.

Referring now to FIGS. 3A through 3C and 4A through 4C, the placement and the use of the movable seat 12 in the shower stall 10 is illustrated. In FIGS. 3A through 3C, the movable seat 12 is shown located in the shower stall 10, but without any weight placed thereon. When the movable seat 12 is placed in the shower stall 10, the rearward end portion 41 of the movable seat 12 (e.g., the rearwardly extending projection 56 of the essentially horizontal support 42) is placed on the upper rear ledge 36 at a first height and a forward end portion 43 of the movable seat 12 (e.g., the foot 48 of the leg 46) is placed at least in part behind the lower frontal threshold 26 at a second height. As can be best seen in FIGS. 3A and 4A, the first height is greater than the second height, meaning that movable seat 12 makes contact with and is supported by the shower stall 10 at various different heights.

In the form illustrated, the ribs on the underside of the essentially horizontal support 42 interface with/are supported by the upper rear ledge 36 as in FIG. 3B and the two forwardly extending portions 50 of the leg 46 engage the lower frontal threshold 26 as in FIG. 3C. One of the pair of stops 58 on the rearwardly extending projection 56 may be placed proximate one of the pair of laterally outwardly-facing vertical walls 38 to position the movable seat 12 along the upper rear ledge 36. Prior to the application of any weight on the seat 12 and as best illustrated in FIG. 3B, the rearwardly facing wall 60 is initially spaced from a back wall 68 of one of the two recessed columns 32 of the shower stall 10.

Figure 4B:
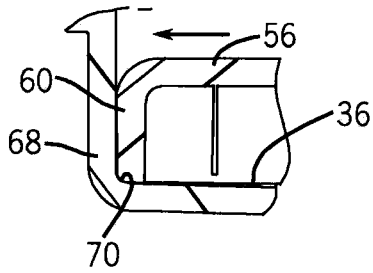
FIG. 4B is a detailed view as defined by line 4B-4B of FIG. 4A.
Figure 4C:
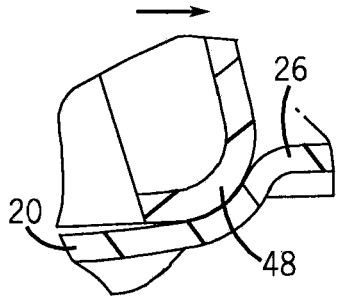
FIG. 4C is a detailed view as defined by line 4C-4C of FIG. 4A.

In FIGS. 4A through 4C, the movable seat 12 is shown with a weight of a human placed on the essentially horizontal support 42, which thereby deforms the movable seat 12 and jams or otherwise secures (e.g., presses, pushes, compresses, etc.) the movable seat 12 into place with respect to the shower stall 10. This deformation is substantially elastic and the material is such that the movable seat 12 will not fracture under the typical applied loads. As best shown in FIG. 4A, the movable seat 12 deforms at the elbow 54 such that the obtuse angle between the essentially horizontal support 42 and the leg 46 increases. This causes the projection 56 to move rearward such that the rearwardly facing wall 60 of the rearwardly extending projection 56 engages the back wall 68 of the shower receptor 14 as shown in FIG. 4B. At the same time and as best seen in FIG. 4C, the foot 48 of the leg 46 is moved (e.g., jammed) into more substantial (e.g., tighter, more forceful, etc.) engagement with the lower frontal threshold 26. This forward and rearward jamming of the movable seat 12 into portions of the shower receptor 14 mounts the movable seat 12 within the shower stall 10, when the weight of a person (which is a weight approximately over 100 pounds) is placed on the movable seat 12. Thus, under the applied load of an individual, the movable seat 12 may be wedged into place within the shower stall 10 by utilizing the elastic flexibility of the seat 12 and the structural confines of the shower stall 10.

As best shown between FIGS. 3C and 4C, upon the increased application of weight to the seat 12, the toe portions 50 are pushed against the threshold 26. Because the material of the seat 12 may be at least somewhat elastically deformable, as the toe portions 50 are pushed against the threshold 26, the rearwardly recessed portion 52 and the upwardly recessed surface 53 between toe portions 50 may bend or bow forward. This bending/bowing will cause a greater portion of the width of the foot 48 to be drawn toward and/or into contact with the lower threshold 26 and better secure the seat 12 within the shower stall 10. It should be appreciated that under lower weight loads, a lesser portion of the foot 48 contacts the threshold 26 and a larger space (e.g., channel, passageway) typically remains between the toe portions 50. This space can continue to facilitate the drainage of water under the upwardly recessed surface 53 of the foot 48.

Notably, proximate the upper rear ledge 36, the angle of the ribs on the underside may help support and guide the essentially horizontal support 42. This causes the outer shell of the seat to be lifted so that, upon jamming the projection 56 into the back wall 68 at the first height, the lower edge of the rearwardly facing wall 60 of the projection 56 does not catch on a radius 70 between the upper rear ledge 36 and the back wall 68 of the shower stall 10.

Nearly simultaneously with the engagement of the rearward end portion 41 with a rearward part of the shower stall 10, the foot 48 of the leg 46 will be drawn into engagement with the lower threshold 26 of the shower stall 10 at the second and lower height. Because the foot 48 can be secured at a height below the seating height (which substantially corresponds to the first height), this seat/shower stall configuration allows for the height of the front threshold 26 to be low. This is advantageous, among other reasons, because it helps facilitate access to the shower stall for an individual requiring the use of such a seat as such an individual may also have difficulty traversing a tall threshold as is common in most bath tub configurations.

Figure 5:
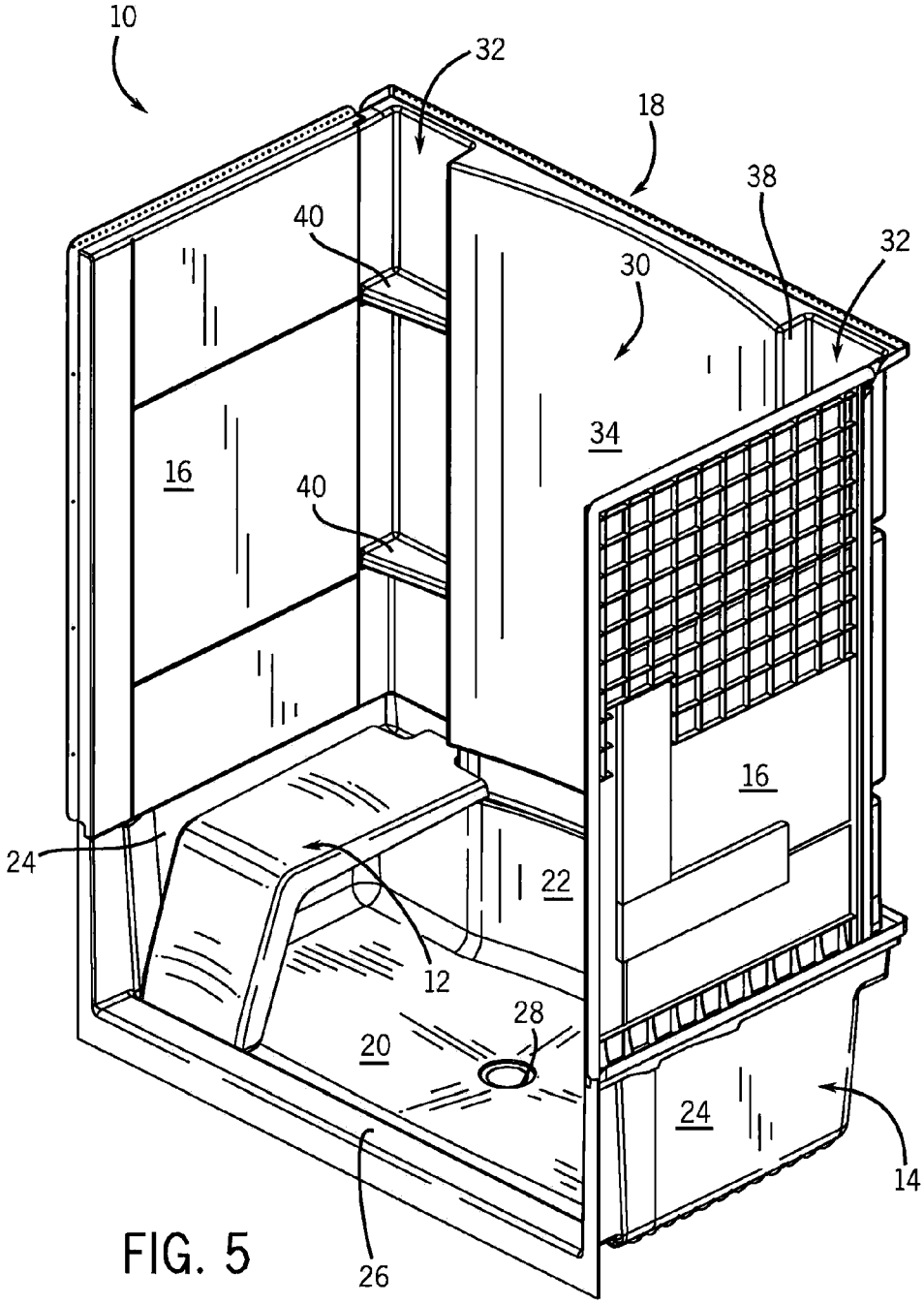
FIG. 5 is a right, frontal, upper perspective view of the shower stall of the FIG. 1, in which the seat is positioned at an alternative location.

Referring now to FIG. 5, the movable seat 12 might be placed on the other side of the shower receptor 14 on the other upper rear ledge 36.

As mentioned earlier, in other configurations of the shower stall, the rear ledge could extend the entire length of the shower stall 10, so that the movable seat might be placed at any point across the upper ledge. Of course, in such an exemplary embodiment, the threshold would be dimensionally positioned relative to the upper ledge to accommodate for the placement anywhere along shower stall 10.

It should be appreciated that various modifications to the movable seat 12 may be made. For example, the under body of the movable seat 12 might be adapted to receive a hanging tray for storage of items. Additionally, the movable seat may have overmolded sections or polymeric sections selectively bonded thereto to create slip-proof surfaces or so forth. Moreover, in some embodiments, the movable seat 12 may be designed such that, when inserted into the shower receptor 14, the movable seat 12 blocks the view of the drain 28.

Referring now to FIG. 8, another shower stall 72 is shown in which the movable seat 12 may be slideably positioned at any of a number of locations over the length of the shower stall 72. As used herein, the term length is used to describe a side-to-side dimension of the shower stall upon which the projection 56 or rearward end portion 41 of the seat 12 may be placed. If for example, a laterally positioned wall extends inwardly from the side the shower receptor, then the length of the upper rear ledge over which the seat 12 may be positioned may be something less than the full length of the shower receptor. In the form shown, the upper rear ledge 74 runs the length of the shower stall 72 and the lower threshold 76 runs parallel to the upper rear ledge 74. The upper rear ledge 74 and the lower threshold 76 may have a straight profile, a curved profile, or other profiles. The portions of the movable seat 12 that engage the shower stall 72 may be shaped to match this profile. For example, the foot 48 of the seat 12 may be curved if the lower threshold is curved.

It will be appreciated that this shower stall 72 and the movable seat 12 are configured such that the movable seat 12 is slideable over the entire length of the shower stall 72. However, in other forms, the seat 12 may be slideable over only one or more portions of the length of the shower stall or may be positionable in one or more discrete positions within the shower stall as shown in FIGS. 1 and 5. Regardless of the particular configuration of the shower stall, when the weight of a human is applied to the seat 12, the seat 12 will jam, wedge or otherwise secure itself into place within the stall, thereby fixing the seat 12 in place under the weight of the user.

Thus, a shower seat is provided that can readily be removed or moved, and/or reinstalled. There is no need for elaborate securing methods to secure the seat in place as when a user sits on the seat, the seat becomes automatically fixed relative to the enclosure.

It should be understood that the term "shower stall" is used in its broadest sense. For example, the stall could be in for form of a combined bathtub and shower.

Thus, it should be appreciated that various modifications and variations to the preferred embodiments can be made within the spirit and scope of the invention, and the invention should not be limited to just the described embodiments. To ascertain the full scope of the invention, the following claims should be referenced.

As utilized herein, the terms "approximately," "about," "substantially," "essentially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" and similar terms as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or movable (e.g., removable or releasable). Such joining may be achieved with the two members or the two members and any additional intermediate members being integrally formed as a single unitary body with one another or with the two members or the two members and any additional intermediate members being attached to one another.

It should be noted that the orientation of various elements may differ according to other exemplary embodiments, and that such variations are intended to be encompassed by the present disclosure.

It is also important to note that the construction and arrangement of the movable seat and shower stall as shown in the various exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter disclosed herein. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present invention as defined in the appended claims. The order or sequence of any process or method steps may be varied or re-sequenced according to alternative embodiments. Other substitutions, modifications, changes and omissions may be made in the design, operating conditions and arrangement of the various exemplary embodiments without departing from the scope of the present inventions.

INDUSTRIAL APPLICABILITY

The invention provides a movable seat for a shower stall.

What is claimed is:

1. A movable seat positionable within a shower stall, the shower stall being of a type having a rear ledge and a lower frontal threshold, the movable seat comprising:

an essentially horizontal support having a rearward end portion that is suitable to be supported on the rear ledge;

a leg extending downwardly from a forward portion of the essentially horizontal support to a foot; and a flexible elbow joining the essentially horizontal support to the leg, wherein the essentially horizontal support, the leg, the foot and the elbow are integrally formed with one another;

wherein the seat is sufficiently flexible that if a weight load of one hundred pounds or more is placed on the essentially horizontal support the foot will flex forwardly in response thereto such that the foot engages the lower frontal threshold of the shower stall and the essentially horizontal support engages a rear portion of the shower stall to create a jam fit to hold the seat in place in the shower stall; and wherein removal of the load will cause the seat to flex to release the jam fit and allow sliding movement of the seat within the shower stall.

2. The movable seat of claim 1, wherein the leg slopes downwardly and forwardly.

3. The movable seat of claim 1, wherein the movable seat comprises at least one of polypropylene, metals, thermoplastic polymers, thermoset polymers, composites, and cellulose materials.

4. The movable seat of claim 1, wherein the rearward end portion of the essentially horizontal support comprises a rearwardly extending projection.

5. The movable seat of claim 4, wherein the rearwardly extending projection has a pair of stops on opposing sides of the rearwardly extending projection.

6. The movable seat of claim 1, wherein the movable seat weighs no more than 10 pounds.

7. A shower stall, comprising:

an upper rear ledge on a rear wall;

a lower frontal threshold; and a seat, comprising:

an essentially horizontal support having a rearward end portion that is supported on the upper rear ledge; and a leg extending downwardly and forwardly from a forward portion of the essentially horizontal support to a foot, the foot being positioned at least in part behind the lower frontal threshold;

wherein when the rearward end portion is supported on the upper rear ledge, and a weight load of one hundred pounds or more is placed on the essentially horizontal support, the foot will flex forwardly in response thereto so as to engage the lower frontal threshold to restrict sliding movement of the seat.

8. The shower stall of claim 7, wherein the essentially horizontal support is joined to the leg by a flexible elbow.

9. The shower stall of claim 7, wherein the rear wall has at least two such discrete, spaced apart, upper rear ledges, such that the seat can be alternatively positioned.

10. The shower stall of claim 7, wherein the upper rear ledge runs along the rear wall for at least a majority of its length and the seat is slideably positionable on the upper rear ledge.

11. A movable seat, comprising:

an essentially horizontal support;

a leg extending generally downward and outward from a forward portion of the essentially horizontal support;

a flexible elbow joining the essentially horizontal support to the leg;

a rearward end portion configured to be supported by a shower stall at a first height; and a forward end portion configured to be supported by the shower stall at a second height, the first height being greater than the second height;

wherein when a weight load of one hundred pounds or more is placed on the essentially horizontal support, the seat is engaged between the shower stall at the first and second heights to create a jam fit that restricts movement of the seat; and wherein when the weight load is removed from the essentially horizontal support, the jam fit is released to allow movement of the seat within the shower stall.

12. The movable seat of claim 11, wherein the first height substantially corresponds to a distance between the essentially horizontal support and a floor of the shower stall.

13. The movable seat of claim 11, wherein the rearward end portion comprises a projection.

14. The movable seat of claim 11, wherein the forward end portion comprises two or more toe portions.

15. The movable seat of claim 11, wherein at least a portion of a sitting surface of the essentially horizontal support is substantially convex.

16. The movable seat of claim 11, wherein a foot at the forward end of the leg includes an upwardly recessed surface between two or more toe portions.

17. The movable seat of claim 11, further comprising a recessed portion proximate to the forward end portion.

18. The movable seat of claim 11, wherein the movable seat is an injection molded polypropylene movable seat.

* * * * *